US008141871B2

(12) United States Patent
Nakazawa

(10) Patent No.: US 8,141,871 B2
(45) Date of Patent: Mar. 27, 2012

(54) IMAGE FORMING APPARATUS

(75) Inventor: Hiroyuki Nakazawa, Kasugai (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 16 days.

(21) Appl. No.: 12/731,081

(22) Filed: Mar. 24, 2010

(65) Prior Publication Data

US 2010/0289210 A1 Nov. 18, 2010

(30) Foreign Application Priority Data

May 13, 2009 (JP) ..... 2009-116637

(51) Int. Cl.
*B65H 7/00* (2006.01)

(52) U.S. Cl. ..... 271/256; 271/258.01; 271/259

(58) Field of Classification Search ..... 271/256, 271/258.01, 258.03, 259
See application file for complete search history.

(56) References Cited

U.S. PATENT DOCUMENTS

| | | | | |
|---|---|---|---|---|
| 5,045,674 | A | 9/1991 | Mita et al. | |
| 5,484,141 | A * | 1/1996 | Yamashita et al. | 271/227 |
| 5,597,154 | A * | 1/1997 | Yamashita | 271/10.05 |
| 5,677,726 | A * | 10/1997 | Fuse | 347/260 |
| 6,188,422 | B1 * | 2/2001 | Ogura | 347/171 |
| 7,014,378 | B2 * | 3/2006 | Saito et al. | 400/582 |
| 7,195,239 | B2 * | 3/2007 | Saito et al. | 271/256 |

FOREIGN PATENT DOCUMENTS

| | | | |
|---|---|---|---|
| JP | 1-108693 | | 4/1989 |
| JP | 5-96760 | | 4/1993 |
| JP | 5-265281 | A | 10/1993 |
| JP | 05262441 | A * | 10/1993 |
| JP | 06144651 | A * | 5/1994 |
| JP | 06144654 | A * | 5/1994 |
| JP | 2000-95449 | | 4/2000 |
| JP | 2000-165612 | A | 6/2000 |

OTHER PUBLICATIONS

Japanese Official Action dated Apr. 12, 2011 together with an English language translation from JP 2009-116637.

Japanese Official Action mailed Aug. 2, 2011 in corresponding Japanese Patent Application No. 2009-116637 together with an English language translation.

* cited by examiner

*Primary Examiner* — Stefanos Karmis
*Assistant Examiner* — Howard Sanders
(74) *Attorney, Agent, or Firm* — Scully, Scott, Murphy & Presser, PC

(57) ABSTRACT

An image forming apparatus includes an image forming unit; a conveyance unit; a motor; a stop order unit that orders stoppage of the motor; a detection unit, which detects a rotated number of the motor or a conveyance distance during a post-order period, and the post-order period being a period from when the stop order unit ordered stoppage of the motor until when the motor stops; a storage unit; a sensor, which detects passage of the recording medium; a timing determination unit, which determines a pre-order period as a appropriate order timing, wherein the pre-order period is calculated from dividing a difference between a first distance and a second distance by a conveyance speed, wherein the first distance is the conveyance distance stored in the storage, and the second distance is a distance between a position where the sensor detects passage of the recording medium and the target stoppage position.

2 Claims, 6 Drawing Sheets

| |
|---|
| FIG. 3A |
| FIG. 3B |

IMAGE FORMING APPARATUS

CROSS-REFERENCE TO RELATED APPLICATION

This application claims priority from Japanese Patent Application No. 2009-116637 filed on May 13, 2009 the entire subject matter of which is incorporated herein by reference.

TECHNICAL FIELD

The present invention relates to an image forming apparatus having a image forming unit that forms an image on a recording medium and, more specifically, to an image forming apparatus that conveys the recording medium through the image forming unit by a conveyance unit activated by a motor.

BACKGROUND

Because properties of the motor or the load of the motor has varied or a load torque of the motor is fluctuated by aging change temperature change, and the like, a known image forming apparatus can not controls accurately a stoppage position of the recording medium,

SUMMARY

Even if properties of the motor or the load of the motor has varied or a load torque of the motor is fluctuated by aging change, temperature change, and the like, the image forming apparatus controls accurately a stoppage position of the recording medium.

DETAILED DESCRIPTION

According to one exemplary embodiment of the invention, an image forming apparatus comprising: an image forming unit that forms an image on a recording medium; a conveyance unit that conveys the recording medium passing through the image forming unit; a motor that activates the conveyance unit; a stop order unit that orders stoppage of the motor; a detection unit, which detects a rotated number of the motor or a conveyance distance during a post-order period, and the post-order period being a period from when the stop order unit ordered stoppage of the motor, which rotate at a constant speed rotation, until when the motor stops; a storage unit, which stores the rotated number or the conveyance distance detected by the detection unit; a sensor, which is disposed in a conveyance path of the recording medium, and which detects passage of the recording medium; and a timing determination unit, which determines a pre-order period as a appropriate order timing for stoppage of the recording medium at a target stop position, wherein the pre-order period is calculated from dividing a difference between a first distance and a second distance by a conveyance speed during the constant speed rotation of the motor, wherein the first distance is one of either the conveyance distance stored in the storage unit or a second conveyance distance corresponding to the rotated number stored in the storage unit, and wherein the second distance is a distance between a position where the sensor detects passage of the recording medium and the target stoppage position for the recording medium.

Accordingly, the image forming unit forms an image on the recording medium when the conveyance unit activated by the motor conveys the recording medium through the image forming unit.

Figure 1:
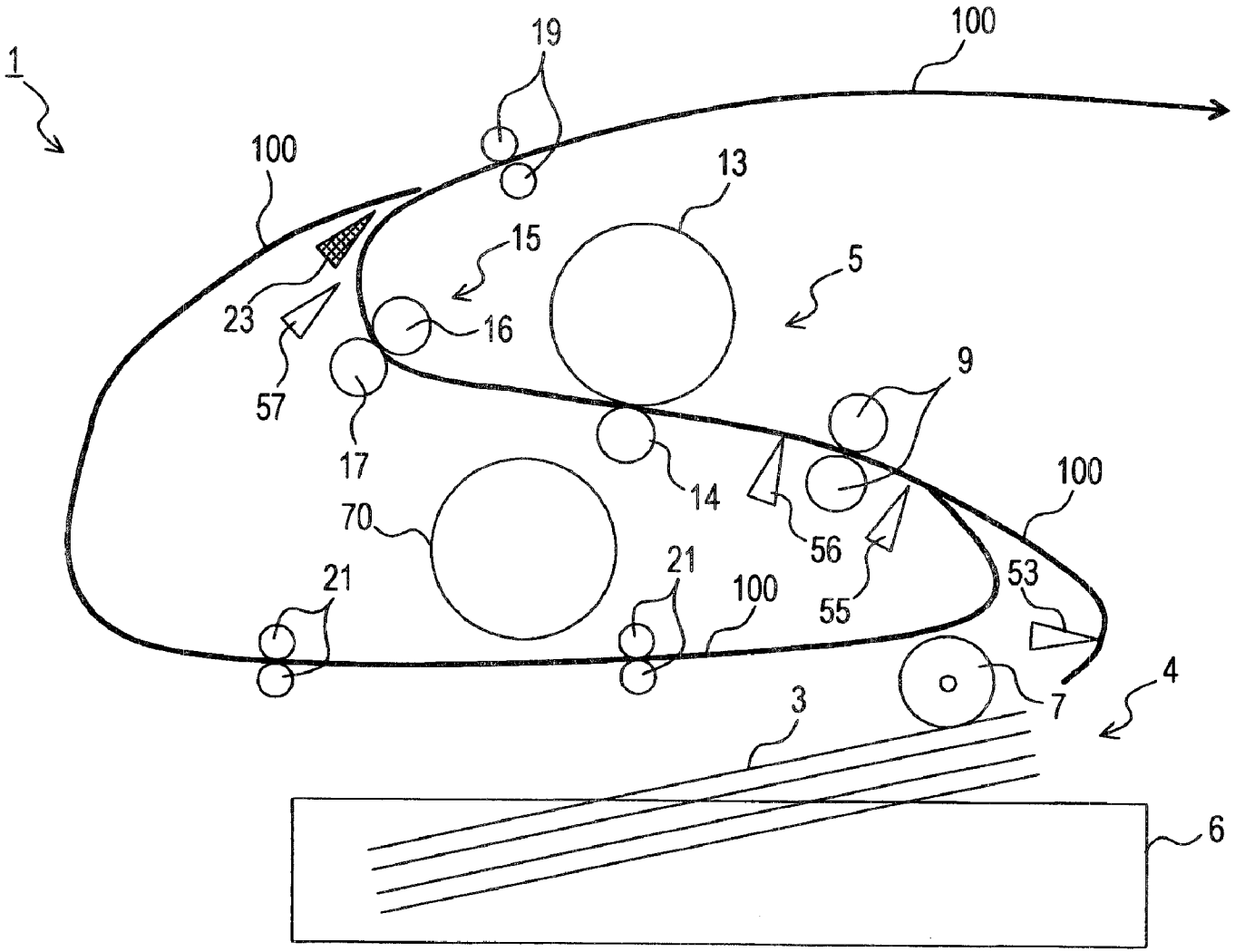
FIG. 1 is a descriptive view schematically showing the structure of a laser printer to which the present invention applies.

An embodiment of the present invention is described by reference to the drawings as follows. As shown in FIG. 1, a laser printer 1 (as an example of a image forming apparatus) is an electro-photographic laser printer forms an image on a sheet 3 (as an example of a recording medium) by developer of nonmagnetic mono-component. The laser printer 1 includes a feeder unit 4 that feeds sheets 3 and a printing unit 5 (as an example of an image forming unit) for forming an image on the sheet 3, and both units is accommodated in a main casing (not shown).

The feeder unit 4 includes a sheet feeding tray 6, which is removably attached to a bottom in the main casing, and a sheet feeding roller 7, which is provided at upper end on one side of the sheet feeding tray 6. The sheet feeding tray 6 has a box shape whose top face is opened so as to stack the sheet 3. The sheet 3 housed in the sheet feeding tray 6 is hold up by a sheet pressure plate (not shown) and is conveyed sheet by sheet by the sheet feeding roller 7. The sheet 3 conveyed by the sheet feeding roller 7 is turned along a conveyance path 100 by unit of a guide (not shown) and is conveyed to a registration roller 9 disposed at positions above the sheet feeding tray 6.

The registration roller 9 is configured a pair of rollers and feed the sheet 3 to a printing position at predetermined timing based on the detection of the sheet 3 by a pre-registration sensor 55 (to be described later). The printing position, where a toner image on a photosensitive drum 13 (to be described later) is transferred onto the sheet 3, is a transfer position in the embodiment, where the photosensitive drum 13 (to be described later) contacts a transfer roller 14.

The printing unit 5 is configured as a well-known electro-photographic printer engine including the photosensitive drum 13, the transfer roller 14, and a fixing unit 15. First, a surface of the photosensitive drum 13 is rotated and is positively electro-statically charged uniformly by a scorotoron charger, or the like, (not shown). Next, the photosensitive drum 13 is exposed by a high-speed scan of a laser beam emitted from a scanner unit (not shown), and an electrostatic latent image is formed based on an image data. A positively electro-statically charged toner supplied from a developing cartridge (not shown) held to an electrostatic latent image formed on the surface of the photosensitive drum 13. Namely, an exposed area on the uniformly and positively electro-statically charged surface of the photosensitive drum 13, where an electric potential is reduced by exposing of the laser beam. Thus, the electrostatic latent image is visualized as a toner image, and a reversal development is formed.

The transfer roller 14 is disposed below and opposite the photosensitive drum 13. During transfer of the toner image, a predetermined transfer current is applied to the transfer roller 14 by constant current control. The toner image held on the surface of the photosensitive drum 13 is transferred onto the sheet 3 by the transfer current during the sheet 3 conveyed from the registration rollers 9 passing between the photosensitive drum 13 and the transfer roller 14.

The sheet 3 transferred toner image is conveyed toward the fixing unit 15. The fixing unit 15 includes a heating roller 16 and a pressure roller 17. The heating roller 16 includes a halogen lamp provided as a heater in a metal pipe. The pressure roller 17 is disposed below and opposite the heating roller 16 such that press the heating roller 16 from below. Therefore, the toner image on the sheet 3 conveyed to the fixing unit 15 is thermally fixed during passing between the heating roller 16 and the pressure roller 17, and subsequently conveyed toward a sheet output roller 19 (as an example of conveyance unit).

The sheet output roller 19 is configured a pair of rollers, which sandwich and convey the sheet 3, and is rotatable in both forward and backward directions depending on forward rotation and backward rotation of a motor 70 (to be described later). The sheet output rollers 19 forwardly rotate and output the sheet 3 fed from the fixing unit 15 to the sheet output tray (not shown). The sheet output rollers 19 backwardly rotate and convey a rear side of the sheet 3 to the printing unit 5 again. The rear side of the sheet 3 is a rear side in a conveyance direction by the sheet feeding roller 7.

A re-conveyance roller 21 (as an example of re-conveyance unit) is provided between the printing unit 5 and sheet feeding tray 6, and configures a plurality of pairs of rollers. A re-conveyance roller 21 conveys sheet 3 conveyed by the backward rotation of the sheet output rollers 19 to the rear side was conveyed to the position of the registration rollers 9. A flapper 23 is disposed between the fixing unit 15 and the sheet output rollers 19 for switching the conveyance path 100 for the sheet 3 between a route extending from the fixing unit 15 toward the sheet output rollers 19 and a route extending from the sheet output rollers 19 to the re-conveyance rollers 21. The flapper 23 is supported swayable in the main casing and can selectively switch the conveyance path 100 for the sheet 3 to any of the routes by excitation or non-excitation of a solenoid (not shown).

When the images are formed on both sides of the sheet 3, the flapper 23 is first switched to a direction in which the sheet 3 is conveyed to the sheet output rollers 19, and the sheet 3 is conveyed in an upward direction of FIG. 1 by the forwardly-rotating sheet output rollers 19. Next, the sheet output rollers 19 are backwardly rotated at timing when the rear end of the sheet 3 has passed by the flapper 23, and the flapper 23 is switched to a direction in which the sheet 3 is delivered to the re-conveyance roller 21.

As a consequence, the rear end side of the sheet 3 is conveyed by the re-conveyance rollers 21 to the printing unit 5 by way of the registration rollers 9 while turned inside out. A reverse face of the sheet 3 conveyed to the printing position is opposing contact with the photosensitive drum 13. After a toner image has been transferred to the reverse face, the fixing unit 15 fixes the toner image and the images are formed on both sides. As shown in FIG. 1, a sheet rear end sensor 53 that detects presence or absence of the sheet 3 is provided at a downstream position with respect to the sheet feeding roller 7 in the direction of conveyance of the sheet. The pre-registration sensor 55 and a post-registration sensor 56 that detect presence or absence of the sheet 3 are provided at backward and forward to the registration rollers 9. A sheet output sensor 57 (as an example of sensor) for detecting presence or absence of the sheet 3 is provided between the fixing unit 15 and the flapper 23.

Figure 2:
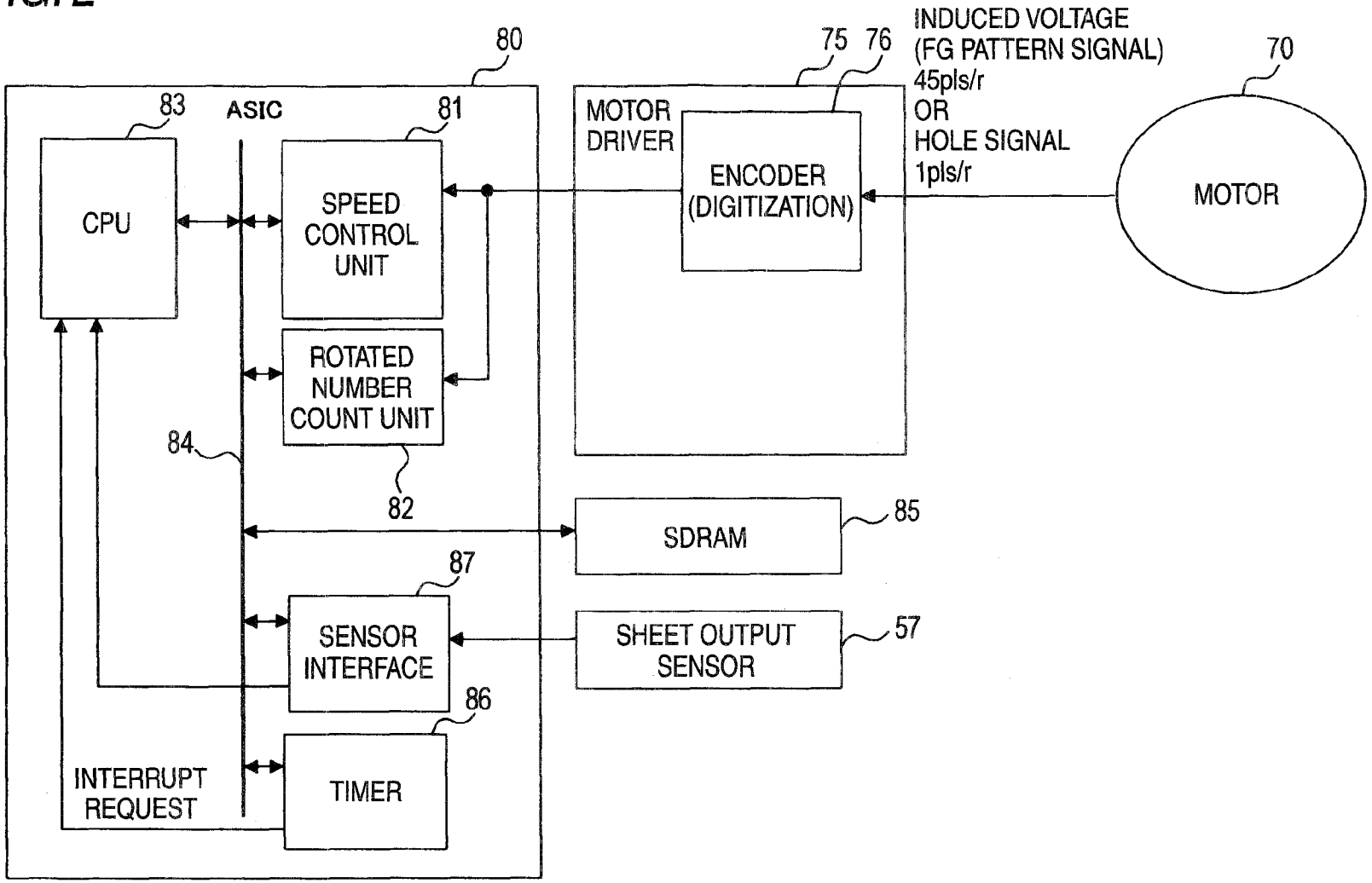
FIG. 2 is a block diagram showing the configuration of a control system of a motor of the laser printer.

FIG. 2 is a block diagram showing the configuration of a control system of the motor 70. The motor 70 is configured as a well-known DC motor having a rotor and a stator. The motor 70 includes a FG pattern, which induce an inductive voltage having 45 pulses per a rotation of the rotor (a so-called FG pattern signal), or a hole element, which outputs a hole signal having one pulse per rotation of the rotor. The inductive voltage or the hole signal is input to an encoder 76 provided in a motor driver 75, and the encoder 76 encodes the voltage or the signal to waveform shaping and generates a digital signal.

An output from the encoder 76 is input to a speed control unit 81 provided in an ASIC 80 and a rotated number count unit 82, which is provided in the ASIC 80, and which includes a counter, or the like. The ASIC 80 includes a CPU 83, which performs various arithmetic processing operations, and the CPU 83 is coupled to the speed control unit 81 and the rotated number count unit 82 via a bus 84. The bus 84 is connected with SDRAM 85 (as an example of storage unit) and a timer 86, and coupled various sensors, such as the sheet output sensor 57, via a sensor interface (sensor IF) 87. An interrupt request, or the like, issued by the timer 86 is input to the CPU 38 via the bus 84. A detection signal from the sheet output sensor 57, or the like, is also input to the CPU 38 via the bus 84. FIG. 2 shows flows of the signals by narrow arrows. The ASIC 80 is further configured to output a drive signal (a well-known CW/CCW and a speed control command) to the motor 70.

Figures 3, 3A:
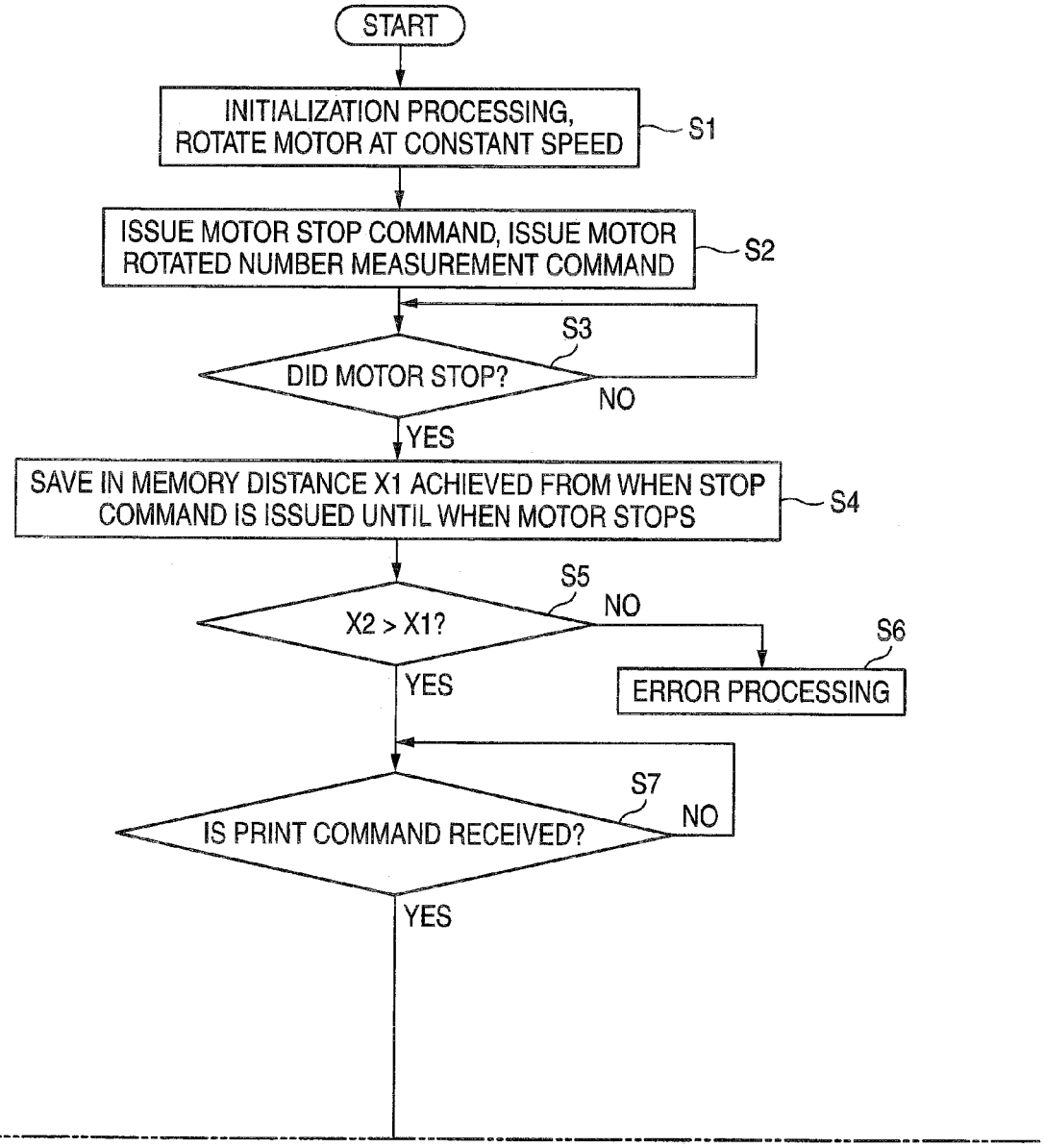
FIG. 3A and FIG. 3B is a flowchart showing processing performed by the control system.
Figure 3B:
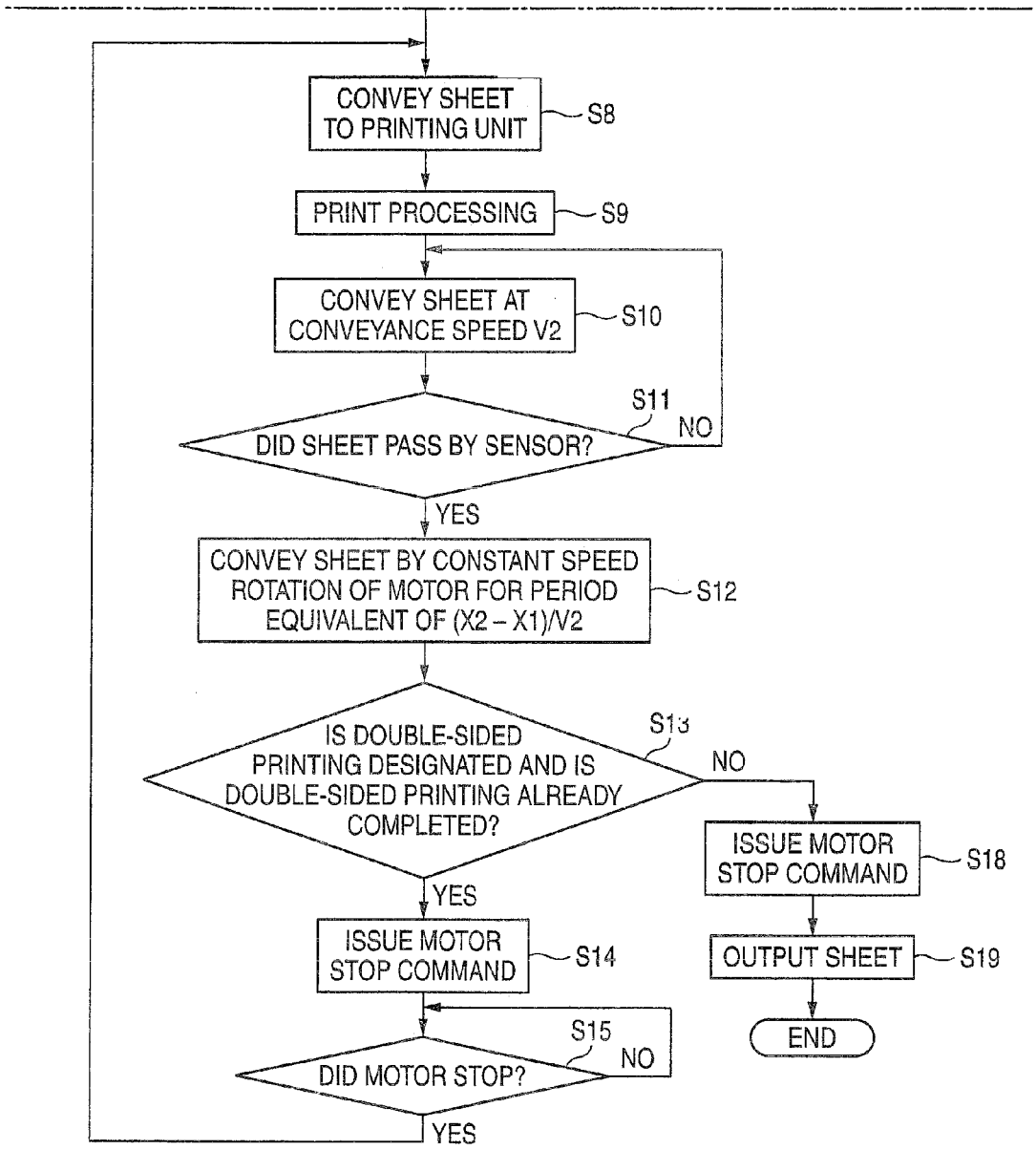

Controls by the ASIC 80 are now described by reference to the flowchart shown in FIG. 3A and FIG. 3B. This processing is performed at power-on time of the laser printer 1 but may also be performed at the time of resetting, or the like, of the laser printer 1. As shown in FIG. 3A, when processing is started, the motor 70 is first (forwardly) rotated at preset, given speed in step S1 (as an example of a initialization processing unit, reference symbol S denotes s step; the same also applies to corresponding explanations). Thus initialization processing (so-called idling) for driving the photosensitive drum 13, and the like, is executed. During initialization processing, the sheet output rollers 19, and the like, coupled to the motor 70 are also rotated via a well-known gear mechanism. However, since the sheet feed roller 7 is coupled to the gear mechanism via an electromagnetic clutch, the sheet feed roller 7 is held at a stoppage. Therefore, the sheet 3 is not conveyed. During initialization processing, the motor 70 is ascertained to be rotating at the predetermined speed.

When initialization processing of S1 ends, the processing proceeds to S2 (as an example of stop order unit), and a motor stop command and a motor rotated number measurement command are issued. When the motor stop command is issued, a speed control command for the motor 70 is set to zero. However, the motor 70 stops after having rotated to some extent by inertia rather than stopping immediately. Accordingly, in this step, the motor rotated number measurement command is issued simultaneously with issuance of the motor stop command. When the rotated number measurement command is issued, the ASIC 80 starts measuring a rotated number of the motor 70 in another routine on the basis of the number of counts of the rotated number count unit 82.

In S3, the processing waits until the motor 70 stops (No in S3). When the motor 70 stopped (Yes in S3), the processing proceeds to S4. In S4 (as an example of detection unit), the rotated number measured from when the motor stop command is issued in S2 until when the motor 70 stopped (Yes in S3) is converted into a conveyance distance X1 (as an example of a first distance) over which the sheet output rollers 19 conveyed the sheet 3, on the basis of the rotated number of the motor 70 measured at the time. The distance is saved (stored) in the SDRAM 85 (as an example of a storage unit).

Figure 4:
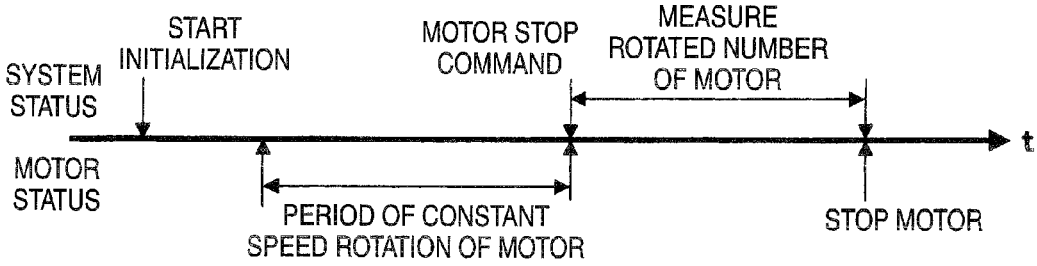
FIG. 4 is a timing chart showing flow of initial processing of the processing.

Specifically, as shown in FIG. 4, when a processing status of the ASIC 80 (the system status) shifts to starting of initialization processing pertaining to S1, after a while, the motor 70 reaches a constant-speed rotating state in which the motor rotates at the predetermined speed. The rotated number count unit 82 measures the rotated number of the motor 70 from when the motor stop command is issued after completion of initialization processing (S2) until when the motor 70 stops. In S4, the conveyance distance X1 of the sheet 3 corresponding with the measured rotated number is saved in the SDRAM 85. The load on the motor 70 is also checked (not shown) as being well known during the course of processing pertaining to S1 to S3

As shown in FIG. 3A, in S5 (as an example of an anomaly determination unit), which is subsequent to S4, whether or not the conveyance distance X1 saved in S4 is smaller than a conveyance distance X2 (as an example of a second distance) of the sheet 3 measured from when the rear end of the sheet 3 passed by the sheet output sensor 57 to when the rear end of the sheet 3 comes to a predetermined position between the flapper 23 and the sheet output rollers 19. The predetermined position is a stop position for the sheet 3 that is suitable for conveying the sheet 3 toward the re-conveyance rollers 21 by swaying the flapper 23 and the backwardly rotating the sheet output rollers 19. When X2 is equal to or smaller than X1 (No in S5), the rear end of the sheet 3 cannot be stopped at the predetermined position even when the motor stop command is issued immediately after the rear end of the sheet 3 has passed by the sheet output sensor 57. Accordingly, in such a case (No in S5), the processing proceeds to S6, and well-known error processing is performed and the motor stops.

Meanwhile, when X2 is more than X1 (Yes in S5), the processing proceeds to S7. In S7, processing waits until a print command is received (No in S7) from an external device, such as a personal computer. When the print command is received (Yes in S7), the processing proceeds to S8 in FIG. 3B. In S8, the motor 70 is rotated at the predetermined speed, and the sheet 3 is conveyed to the printing unit 5 by the sheet feeding roller 7, or the like. In subsequent S9, a drive signal is output to the scanner unit, or the like, and the printing unit 5 performs print processing (the image forming operation).

When the print processing is completed by S9, the motor 70 is rotated at the predetermined speed and activate the heating roller 16 and the sheet output rollers 19 of the fixing unit 15 in S10. The sheet 3 is conveyed at conveyance speed V2 corresponding to the predetermined speed. In S11, it is determined whether or not the rear end of the sheet 3 passed by the sheet output sensor 57. When the rear end of the sheet 3 has not yet passed by the sheet output sensor 57 (No in S11), the processing return to S10 and the conveyance of the sheet 3 is continually carried out. When the rear end of the sheet 3 passed by the sheet output sensor 57 (Yes in S11), the processing proceeds to S12.

In S12, the motor 70 is rotated at constant speed for only a period of time calculated by an expression (X2−X1)/V2, and the processing proceeds to S13. A calculation processing on (X2−X1)/V2 in S12 correspond to an example of timing determination unit.

In S13 subsequent to S12, it is determined whether or not double-sided printing is ordered and whether or not double-sided printing is not completed (namely, printing of only one side has finished). When double-sided printing is ordered and when double-sided printing has not completed (Yes in S13), the processing proceeds to S14 (as an example of stop order unit) and the motor stop command is immediately issued. As mentioned previously, the rear end of the sheet 3 is stopped at the predetermined position where the rear end of the sheet 3 reaches as result of being additionally conveyed over the conveyance distance X2 after passed through the sheet output sensor 57 (Yes in S11).

In S15, the processing waits until the motor 70 stops (No in S15). When the motor 70 stopped (Yes in S15), the processing proceeds to S8. The flapper 23 is then swayed, and the motor 70 is also backwardly rotated. As a result, the sheet 3 is conveyed via the re-conveyance rollers 21. The motor 70 is switched to forward rotation at appropriate timing, whereby the sheet 3 is conveyed to the printing unit 5 while turned inside out. By the processing of S9 to S12, the reverse side of the sheet 3 also undergoes printing. When the processing proceeds to S13, the sheet has finished undergoing double-sided printing (No in S13) and the processing proceeds to S18. When single-sided printing is ordered at first (No in S13), the processing does not proceeds to S14, or the like, and the processing proceeds to S18 after a determination is made S13 in first.

In S18, the motor stop command is issued to the motor 70. The motor stop command is issued after a lapse of a little time since processing shifted to S18 rather than being issued immediately. The sheet 3 passes by the sheet output rollers 19 by inertial rotation of the motor 70, or the like, and exit to the sheet output tray (S19), and processing temporarily ends. The ASIC 80 does not substantially perform the processing of S19 shown in FIG. 3B. The processing of S19 represents sheet output operation as operation of the laser printer 1.

As mentioned above, in the present embodiment, the rotated number measured from a point in time (S2) when the motor stop command is issued after completion of initialization processing (S1) until when the motor 70 actually stops (Yes in S3) is converted into the conveyance distance X1 over which the sheet output rollers 19 conveyed the sheet 3, and the distance is saved (S4). Motor stop command issuance timing in double-sided printing is determined by the conveyance distance X1 (S12 and S14). Accordingly, even if properties of the motor 70 or the load of the motor 70 has varied or a load torque of the motor 70 is fluctuated by aging change, temperature change, and the like, the sheet 3 can accurately be stopped at the predetermined position as follows.

Figure 5:
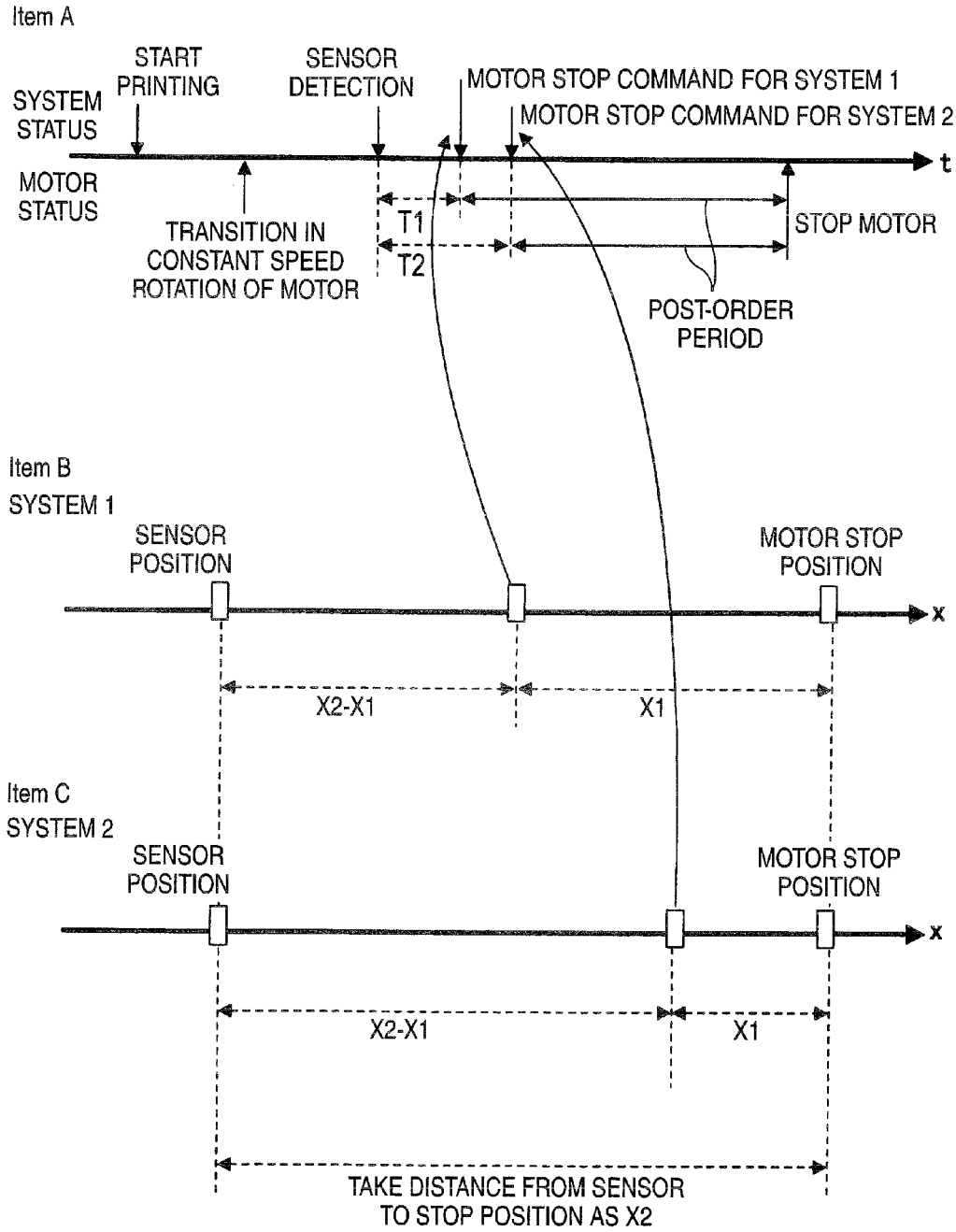
FIG. 5 are timing charts schematically showing effects of the processing.

As shown in item B and C of FIG. 5, there are two systems; a system 1 and a system 2, in which values saved in S4 as the conveyance distance X1 differ from each other for reasons of the variations in properties, and secular change, temperature change, and the like, as mentioned previously. In the case of a system 1, the time calculated by the foregoing expression (X2−X1)/V2 is denoted by T1 shown in item A of FIG. 5. In the case of a system 2, the time calculated by the foregoing expression (X2−X1)/V2 in connection with the system 2 is denoted by T2 in item A of FIG. 5.

Therefore, as shown in item A of FIG. 5, print processing (S9) has started, the motor 70 comes into a constant rotating state in which the motor rotates at the predetermined speed (corresponding to the sheet conveyance speed V2). In the case of the system 1, the motor stop command is issued after a lapse of time T1 since the rear end of the sheet 3 passed by the sheet output sensor 57 (Yes in S11). And in the case of the system 2, the motor stop command is issued after a lapse of time T2 since the rear end of the sheet 3 passed by the sheet output sensor 57 (Yes in S11). The timing for issuing the motor stop command changes between the system 1 and the system 2 according to the conveyance distance X1 that is changed by the characteristics, or the like. The position of the sheet 3 achieved at the time of stoppage of the motor 70 can be uniformed respectively for the system 1 and the system 2.

Accordingly, in the embodiment, the sheet 3 can reliably be sent to the re-conveyance rollers 21 during double-sided printing.

In the embodiment, when X2 is equal to or smaller than X1 (No in S5) in the motor 70 stopped after completion of initialization processing (Yes in S3), the processing proceeds to error processing (S6). Therefore, an anomaly in the drive system, such as the rollers 19, can be determined before starting of print processing.

The present invention is not limited to the embodiment mentioned above, and the like, and can be modified in various forms without departing the substance of the present invention. For instance, in the embodiment, when the motor stop command is issued (S2) after completion of initialization processing (S1), the conveyance distance X1 is detected. However, the conveyance distance X1 detected when the motor stop command is issued after completion of previous print processing can also be utilized. The processing for detecting the conveyance distance X1 may also be performed special processing. When the conveyance distance X1 is detected after completion of initialization processing as in the above embodiment, the processing can be made efficient in both a time and power conservation.

In the embodiment, the SDRAM 85 stores the conveyance distance X1. However, the rotated number detected via the rotated number count unit 82 for the purpose of detecting the conveyance distance X1 can also be saved. In this case, if the rotated number is converted into the conveyance distance X1 in S12, the processing similar to the embodiment can be performed. Moreover, in the embodiment, the present invention is applied to controlling a stop position for the sheet 3 being reconveyed during double-sided printing, but the present invention can also be applied to various control operations, such as operation for controlling stoppage of the sheet 3 on a sheet-feeding side prior to the printing unit 5. If the position where the sheet 3 is to be stopped when reconveyed cannot accurately be controlled, a problem will arise in double-sided printing, such as the sheet 3 being snagged on the flapper 23. Accordingly, when the stop position for the sheet 3 is controlled during double-sided printing as mentioned in connection with the embodiment, the advantage of the present invention is exhibited much noticeably.

What is claimed is:

1. An image forming apparatus comprising:

an image forming unit configured to form an image on a recording medium;

a conveyance unit configured to convey the recording medium passing through the image forming unit;

a motor configured to activate the conveyance unit;

a stop order unit configured to order stoppage of the motor;

a detection unit, configured to detect a rotated number of the motor or a conveyance distance during a post-order period, and the post-order period being a period from when the stop order unit ordered stoppage of the motor, which rotate at a constant speed rotation, until when the motor stops;

a storage unit, configured to store the rotated number or the conveyance distance detected by the detection unit;

a sensor, disposed in a conveyance path of the recording medium, and configured to detect passage of the recording medium;

a timing determination unit, configured to determine a pre-order period as a appropriate order timing for stoppage of the recording medium at a target stop position, the pre-order period is calculated from dividing a difference between a first distance and a second distance by a conveyance speed during the constant speed rotation of the motor, the first distance being one of either the conveyance distance stored in the storage unit or a second conveyance distance corresponding to the rotated number stored in the storage unit, and the second distance being a distance between a position where the sensor detects passage of the recording medium and the target stoppage position for the recording medium, an initialization processing unit, configured to drive the motor without conveying the recording medium, and perform initialization processing that activates the image forming unit and the conveyance unit, and an anomaly determination unit, configured to determine an anomaly state when the second distance is smaller than the first distance;

wherein the detection unit detects the rotated number or the conveyance distance, when the stop order unit orders the stoppage of driving of the motor after a completion of initialization processing by the initialization processing unit.

2. An image forming apparatus comprising:

an image forming unit configured to form an image on a recording medium;

a conveyance unit configured to convey the recording medium passing through the image forming unit;

a motor configured to activate the conveyance unit;

a stop order unit configured to order stoppage of the motor;

a detection unit, configured to detect a rotated number of the motor or a conveyance distance during a post-order period, and the post-order period being a period from when the stop order unit ordered stoppage of the motor, which rotate at a constant speed rotation, until when the motor stops;

a storage unit, configured to store the rotated number or the conveyance distance detected by the detection unit;

a sensor, disposed in a conveyance path of the recording medium, and configured to detect passage of the recording medium; and a timing determination unit, configured to determine a pre-order period as a appropriate order timing for stoppage of the recording medium at a target stop position, the pre-order period is calculated from dividing a difference between a first distance and a second distance by a conveyance speed during the constant speed rotation of the motor, the first distance being one of either the conveyance distance stored in the storage unit or a second conveyance distance corresponding to the rotated number stored in the storage unit, and the second distance being a distance between a position where the sensor detects passage of the recording medium and the target stoppage position for the recording medium; and a re-conveyance unit, configured to convey the recording medium, on which the image is formed one side of the recording medium by the image forming unit, to the image forming unit again, wherein the target stop position is a stop position appropriate for conveyance by the re-conveyance unit.

* * * * *